US005609899A

United States Patent [19]

Spector

[11] Patent Number: 5,609,899

[45] Date of Patent: Mar. 11, 1997

[54] COLLAPSIBLE CANTEEN FOR SOFT DRINK

[76] Inventor: Donald Spector, 380 Mountain Rd., Union City, N.J. 07080

[21] Appl. No.: 543,614

[22] Filed: Oct. 16, 1995

Related U.S. Application Data

[63] Continuation-in-part of Ser. No. 498,375, Jul. 5, 1995.

[51] Int. Cl.[6] ..... B65D 85/00

[52] U.S. Cl. ..... 426/111; 426/112; 222/107; 229/108.1; 229/117.01

[58] Field of Search ..... 222/92, 107, 153.05, 222/562; 229/108.1, 117.01, 117.05, 117.08, 123.1; 426/111, 112, 115

[56] References Cited

U.S. PATENT DOCUMENTS

| | | | |
|---|---|---|---|
| 3,319,684 | 5/1967 | Calhoun | 229/117.07 |
| 3,354,924 | 11/1967 | Birrell et al. | 222/107 |
| 3,542,566 | 11/1970 | Wakefield | 426/112 |
| 3,559,847 | 2/1971 | Goodrich | 222/107 |
| 5,384,138 | 1/1995 | Robbins, III et al. | 426/111 |

FOREIGN PATENT DOCUMENTS

| | | | |
|---|---|---|---|
| 2038069 | 2/1972 | Germany | 426/111 |
| 2181062 | 4/1987 | United Kingdom | 426/111 |

*Primary Examiner*—Philippe Derakshani
*Attorney, Agent, or Firm*—Michael Ebert

[57] ABSTRACT

A collapsible canteen having deposited therein a charge of water-soluble flavor crystals such that when the canteen is erected and water is poured therein, the crystals are then dissolved to produce, in situ, a soft drink. The canteen includes square top and bottom walls, the top wall having a projecting neck to receive a removable cap. Also included are a first pair of opposing side walls that are inwardly foldable in half whereby when the canteen is collapsed, the folded in first side walls are then sandwiched between the top and bottom walls, and a second pair of opposing side walls that are outwardly foldable in half and are each provided with a triangular gusset that is joined to a side wall in the first pair of side walls, whereby when the canteen is collapsed, the gussets are then folded into the folded out second pair of side walls to define a pair of outstretched wings, the wings being then folded under the bottom wall to create a square-shaped pack.

7 Claims, 1 Drawing Sheet

COLLAPSIBLE CANTEEN FOR SOFT DRINK

RELATED APPLICATIONS

This application is a continuation-in-part of my copending application Ser. No. 08/498,375 filed Jul. 5, 1995, entitled "Squeeze Canteen for Soft Drink" the disclosure of which is incorporated therein by reference.

BACKGROUND OF INVENTION

1. Field of Invention

This invention relates generally to canteens for dispensing potable liquids, and more particularly to a collapsible canteen which when erected, produces in situ a soft drink or other drink in which powders or crystals are dissolved in water.

2. Status of Prior Art

A canteen in a flask for carrying drinking water or other potable liquids. Canteens are now commonly used by hikers and other travelers to carry potable liquids such as drinking water and fruit juice. Usually a canteen takes the form of a metal or plastic flask having a removable screw-on cap. These are not suitable for preschool or very young children; for in order to drink from a conventional canteen, the child must unscrew the cap, which is usually chained to the flask, and then put the threaded metallic or hand plastic neck of the flask into his mouth. Since the flask is filled with liquid and is fairly heavy, a young child runs the risk of striking and damaging his teeth with the threaded neck of the flask.

While a child can quench his thirst with pure cold water, most children particularly when attending an amusement or theme park such as Disney World, prefer a cold soft drink. The problem a parent often faces in a popular amusement park when accompanying a thirsty child, is that while there are usually cold water fountains available from which the child is free to drink, the cold soft drink the child would prefer is not readily available. Indeed, on a busy day in an amusement park, there are usually long lines extending from the kiosks which sell cold soft drinks. And not only must one wait a fairly long period to obtain a cold soda, but its price is generally quite high, far more so than the going price in a retail supermarket.

It is known to produce a cold soft drink suitable for children by dissolving flavor crystals in cold water, one popular brand of such crystals being the COOL AID brand. These crystals combine a sweetener with a flavoring agent such as a cherry or orange flavor, to produce a low-cost soft drink acceptable for children.

While at home where a glass, and a stirring spoon are available to produce a cold soft drink from flavor crystals, it is not feasible to carry this equipment to an amusement park or other outdoor site to provide children with soft drinks.

My copending application, above-identified, provides a squeeze canteen for producing, in situ, a cold soft drink, and then dispensing the drink, thereby making available to a child in an amusement or theme park, or other outdoor site provided with a cold water supply such as a fountain, an inexpensive, yet satisfying drink.

This canteen includes a collapsible pouch molded to simulate a known character and provided with a female socket forming the mouth of the pouch. Inserted in the socket is a removable male nozzle plug incorporating a normally-closed valve. Deposited in the pouch is a charge of water-soluble flavor crystals. When cold water is poured into the pouch through its mouth, the crystals are then dissolved to produce a soda drink that is then sealed in the pouch by the plug inserted in the socket. To drink from the canteen, the valve is first opened and the pouch is then squeezed to pressurize the soda drink and discharge it from the nozzle plug.

SUMMARY OF INVENTION

The main object of this invention is to provide a collapsible canteen having deposited therein a charge of water-soluble flavor crystals such that when the canteen is erected and water is poured therein, the crystals are then dissolved to produce in situ a soft drink.

More particularly, it is an object of this invention to provide a collapsible carton having foldable sides and gussets which make it possible to collapse the carton without difficulty.

Briefly stated, these objects are attained by a collapsible canteen having deposited therein a charge of water-soluble flavor crystals such that when the canteen is erected and water is poured therein, the crystals are then dissolved to produce, in situ, a soft drink. The canteen includes square top and bottom walls, the top wall having a projecting neck to receive a removable cap. Also included are a first pair of opposing side walls that are inwardly foldable in half whereby when the canteen is collapsed, the folded in first side walls are then sandwiched between the top and bottom walls, and a second pair of opposing side walls that are outwardly foldable in half and are each provided with a triangular gusset that is joined to a side wall in the first pair of side walls, whereby when the canteen is collapsed, the gussets are then folded into the folded out second pair of side walls to define a pair of outstretched wings, the wings being then folded under the bottom wall to create a square-shaped pack.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
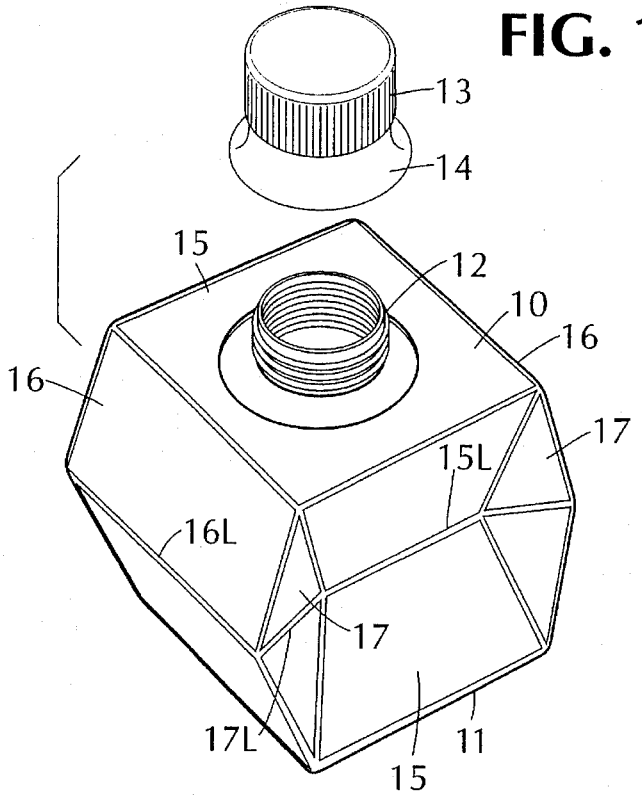
FIG. 1 is a perspective view of a collapsible canteen in accordance with the invention, as seen in its erected state with its cap removed.

Referring now to FIG. 1, there is shown a collapsible canteen in accordance with the invention as it appears in its erected state. The canteen is preferably fabricated of the same material from which a conventional milk carton is formed, the material being a paper board whose interior surface is coated with a thin liquid-impervious plastic film, such as polyethylene, to provide a liquid barrier. Hence the canteen is formed of relatively soft material.

The canteen includes square top and bottom walls 10 and 11, the top wall being provided at its center with a projecting neck 12. Neck 12 is externally threaded to receive a removable screw-on cap 13. The neck is hermetically sealed by a detachable plastic film or foil seal 14 of the type generally used to seal orange juice cartons to ensure the sterility of the contents.

Extending between the top and bottom walls of the canteen is a first pair of opposing side walls 15 having a fold line 15L whereby each of these walls is foldable inwardly in half. Also extending between the top and bottom walls is a second pair of opposing side walls 16 having a fold line 16L whereby each of these walls may be outwardly folded in half.

The pair of second side walls 16 are each provided with a triangular gusset 17 that is integral with the related first side wall 15. Each gusset 17 is provided with a fold line 17L which is aligned with fold lines 15L and 16L so that the side walls and the gussets fold simultaneously.

Figure 2:
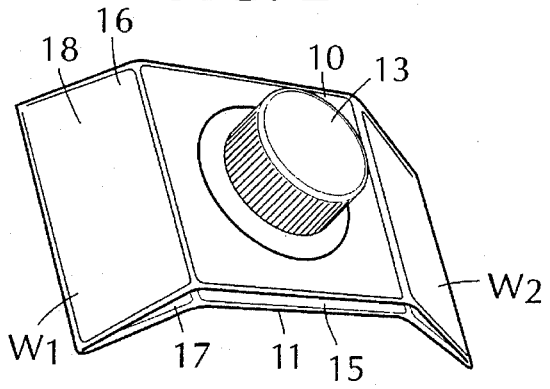
FIG. 2 shows the canteen in its collapsed state.

To collapse the canteen, the side wall 15 are folded in so that as shown in FIG. 2, the folded-in side walls are then sandwiched between the top and bottom walls 10 and 11. And gussets 17 are folded into the folded out side walls 16 to define a pair of outstretched wings $W_1$ and $W_2$. FIG. 2, therefore shows the collapsed state of the canteen.

Figure 3:
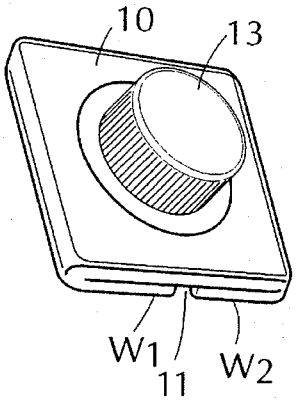
FIG. 3 shows the canteen in its pack state.

In order to render the canteen still more compact, the wings $W_1$ and $W_2$ are folded in under the bottom wall 11 of the canteen, as shown in FIG. 3, to create a square pack occupying very little space. This pack may be packaged in a plastic envelope.

Figure 4:
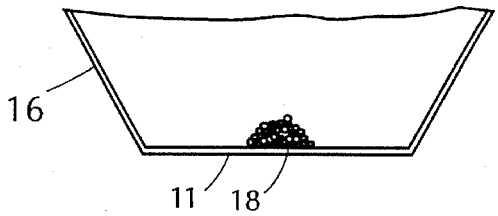
FIG. 4 shows a deposit of flavor crystals in the canteen.

Before the canteen is collapsed, cap 13 is unscrewed from the neck and then deposited in the canteen, as shown in FIG. 4, is as charge 18 of water-soluble flavor crystals. When these crystals are dissolved in water, a soft drink is produced having an orange, a grape or other flavor. In practice, the color of the canteen matches that of the flavor, so if the soda is an orange drink, the canteen is then orange colored, and if it is a grape drink, the carton has a purple color.

After the crystals are deposited in the canteen, it is collapsed to exhaust the air therefrom and then sealed by seal 14. Because of this seal, external air pressure acts to maintain the canteen in its collapsed state. Then the cap 13 is screwed back onto the collapsed canteen.

When one wishes to put the canteen to use, the seal is detached and the cap is removed, the canteen then being erected (see FIG. 1). Cold water is now poured into the erected canteen to fill it, and the cap is then screwed back so that the canteen can be shaken to fully dissolve the flavor crystals in the water. Now the canteen contains a soft drink which can be imbibed by a child.

While there has been shown a preferred embodiment of a three spot game in accordance with the invention, it will be appreciated that many changes may be made therein without departing from the spirit of the invention. Thus instead of depositing flavor crystals in the canteen to produce a soft drink, one may depose a water-soluble pharmaceutical powder such as an anti-acid product (ALKA-SELTZER) which requires water to produce a drink.

I claim:

1. A collapsible canteen comprising:

A. square top and bottom walls, the top wall being provided with a projecting neck on which a removable cap is received;

B. a first pair of opposed side wall extending between the top and bottom walls and being inwardly foldable in half whereby when the canteen is collapsed the folded-in first pair of side walls is sandwiched between said top and bottom walls;

C. a second pair of opposed side walls extending between the top and bottom walls and being outwardly foldable in half, said second pair of walls being each provided with a triangular gusset that is joined to a side wall in the first pair of walls whereby when the canteen is collapsed, the gussets are then folded into the folded out second pair of side walls to define a pair of outstretching wings.

2. A canteen as set forth in claim 1, having a deposit therein of a charge of flavoring crystals whereby when the cap is removed from the neck and the canteen is then filled with water, a soft drink is then produced.

3. A canteen as set forth in claim 1, in which the outstretched wings are folded under the bottom wall to create a pack.

4. A canteen as set forth in claim 1, in which a detachable seal is applied to the neck when the canteen is in its collapsed state to prevent the canteen from expanding.

5. A canteen as set forth in claim 1, in which the canteen is fabricated of paper board whose inner surface is coated with a liquid-impervious plastic film.

6. A canteen as set forth in claim 2, in which the canteen is provided with an exterior color which matches the color of the soft drink.

7. A canteen as set forth in claim 1, having a deposit therein of a water-soluble pharmaceutical.

* * * * *